US009400478B2

(12) United States Patent
Mimura

(10) Patent No.: US 9,400,478 B2
(45) Date of Patent: Jul. 26, 2016

(54) IMAGE FORMING APPARATUS, IMAGE FORMING METHOD AND NON-TRANSITORY COMPUTER-READABLE STORAGE DEVICE HAVING IMAGE FORMING PROGRAM

(71) Applicant: Brother Kogyo Kabushiki Kaisha, Nagoya-shi, Aichi-ken (JP)

(72) Inventor: Chieko Mimura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/793,855

(22) Filed: Jul. 8, 2015

(65) Prior Publication Data

US 2016/0011556 A1 Jan. 14, 2016

(30) Foreign Application Priority Data

Jul. 9, 2014 (JP) ..... 2014-141644

(51) Int. Cl.
*G03G 21/00* (2006.01)
*G03G 21/08* (2006.01)
*G03G 15/047* (2006.01)

(52) U.S. Cl.
CPC ..... *G03G 21/08* (2013.01); *G03G 15/047* (2013.01); *G03G 21/0094* (2013.01); *G03G 2215/0141* (2013.01)

(58) Field of Classification Search
CPC ... G03G 15/045; G03G 15/047; G03G 21/06; G03G 21/08; G03G 21/0094
USPC ..... 399/72, 128, 186, 301
See application file for complete search history.

(56) References Cited

U.S. PATENT DOCUMENTS

| | | | | |
|---|---|---|---|---|
| 5,099,279 | A * | 3/1992 | Shimizu | 399/49 |
| 9,058,012 | B2 | 6/2015 | Hanano et al. | |
| 2014/0161480 | A1 | 6/2014 | Hanano et al. | |

FOREIGN PATENT DOCUMENTS

| | | | | |
|---|---|---|---|---|
| JP | 2008-076792 | A | 4/2008 | |
| JP | 2008076792 | A * | 4/2008 | G03G 15/00 |
| JP | 2014-021266 | A | 2/2014 | |

* cited by examiner

*Primary Examiner* — Benjamin Schmitt
(74) *Attorney, Agent, or Firm* — Banner & Witcoff, Ltd.

(57) ABSTRACT

An image forming apparatus includes a photosensitive member, a charge eliminating device eliminating charges on the photosensitive member, a charging device charging the photosensitive member, a developing device attaching charged developer to an electrostatic latent image formed on the charged photosensitive member and developing the electrostatic latent image, and a control device configured to switch a luminescence intensity of the charge eliminating device between a first luminescence intensity and a second luminescence intensity, the second luminescence intensity being lower than the first luminescence intensity, and to adjust a density of an image, which is obtained by developing the electrostatic latent image by the developing device, in response to the luminescence intensity being switched from the first luminescence intensity to the second luminescence intensity or from the second luminescence intensity to the first luminescence intensity.

15 Claims, 4 Drawing Sheets

| NUMBER OF PRINTED SHEETS | GRADIENT | |
|---|---|---|
| | on | off |
| 0 | K0 | L0 |
| 500 | K1 | L1 |
| 1000 | K2 | L2 |
| ⋮ | ⋮ | ⋮ |

IMAGE FORMING APPARATUS, IMAGE FORMING METHOD AND NON-TRANSITORY COMPUTER-READABLE STORAGE DEVICE HAVING IMAGE FORMING PROGRAM

CROSS-REFERENCE TO RELATED APPLICATION

This application claims priority from Japanese Patent Application No. 2014-141644 filed on Jul. 9, 2014, the entire subject-matter of which is incorporated herein by reference.

TECHNICAL FIELD

The disclosure relates to an image forming apparatus, an image forming method, and a program, and more particularly, to an electrophotographic image forming apparatus, an image forming method, and a program.

BACKGROUND

There has been proposed an image forming apparatus including a photosensitive drum and a charge eliminating lamp, which is provided around the photosensitive drum and is configured to eliminate charges on a circumferential surface of the photosensitive drum after transfer. The image forming apparatus includes a unit frame main body configured to hold the photosensitive drum, and a holder frame configured to hold the charge eliminating lamp and detachably mounted to the unit frame main body. There has been disclosed a configuration for easily cleaning the charge eliminating lamp.

Regarding an image to be transferred to a sheet, an image quality defect may be caused due to paper dust, toner and the like attached to the photosensitive drum. That is, a black spot is transferred to the sheet due to the paper dust, the toner and the like, so that the image quality defect is caused. The image quality defect may worsen under high humidity environments. Regarding this, it has been proven that the image quality defect is improved by weakening a luminescence intensity of the charge eliminating lamp. Therefore, in order to improve the image quality defect the luminescence intensity of the charge eliminating lamp is weakened, depending on the humidity. In this case, however, even though the image quality defect such as black spot is improved, a density of the transferred image may be changed due to a difference of the luminescence intensity of the charge eliminating lamp.

SUMMARY

Illustrative aspects of the present disclosure provide an image forming apparatus, an image forming method, and a program capable of reducing non-uniformity of an image density by suppressing a difference in a density of a printed image even when a luminescence intensity of a charge eliminating lamp is changed.

One illustrative aspect of the disclosure provides an image forming apparatus comprising: a photosensitive member; a charge eliminating device configured to eliminate charges on the photosensitive member; a charging device configured to charge the charge-eliminated photosensitive member; a developing device configured to attach charged developer to an electrostatic latent image, which is formed on the charged photosensitive member, by an electrostatic force and to develop the electrostatic latent image; and a control device. The control device is configured to: switch a luminescence intensity of the charge eliminating device between a first luminescence intensity and a second luminescence intensity, the second luminescence intensity being lower than the first luminescence intensity; and adjust a density of an image, which is obtained by developing the electrostatic latent image by the developing device, in response to the luminescence intensity being switched from the first luminescence intensity to the second luminescence intensity or from the second luminescence intensity to the first luminescence intensity.

Another illustrative aspect of the disclosure provides an image forming method of an image forming apparatus comprising a photosensitive member; a charge eliminating device configured to eliminate charges on the photosensitive member; a charging device configured to charge the charge-eliminated photosensitive member; and a developing device configured to attach charged developer to an electrostatic latent image, which is formed on the charged photosensitive member, by an electrostatic force and to develop the electrostatic latent image, the method comprising: switching a luminescence intensity of the charge eliminating device between a first luminescence intensity and a second luminescence intensity, the second luminescence being lower than the first luminescence intensity; and adjusting a density of an image to be obtained by developing the electrostatic latent image by the developing device, in response to the luminescence intensity being switched from the first luminescence intensity to the second luminescence intensity or from the second luminescence intensity to the first luminescence intensity.

Still another illustrative aspect of the disclosure provides a non-transitory computer-readable storage medium having a computer program stored thereon and readable by a computer of an image forming apparatus, the image forming apparatus comprising: a photosensitive member; a charge eliminating device configured to eliminate charges on the photosensitive member; a charging device configured to charge the charge-eliminated photosensitive member; and a developing device configured to attach charged developer to an electrostatic latent image, which is formed on the charged photosensitive member, by an electrostatic force and to develop the electrostatic latent image, the computer program, when executed by the computer, causes the computer to perform operations comprising: switching a luminescence intensity of the charge eliminating device between a first luminescence intensity and a second luminescence intensity lower than the first luminescence intensity; and adjusting a density of an image to be obtained by developing the electrostatic latent image by the developing device, in response to the luminescence intensity being switched from the first luminescence intensity to the second luminescence intensity or from the second luminescence intensity to the first luminescence intensity by the switching processing.

According thereto, when the luminescence intensity of the charge eliminating device is switched from the first luminescence intensity to the second luminescence intensity or from the second luminescence intensity to the first luminescence intensity, it is possible to adjust the density of an image, which is obtained by developing the electrostatic latent image by the developing device, depending on the luminescence intensity. Also, it is possible to suppress a difference of the image density, which is caused due to the difference of the luminescence intensity of the charge eliminating device. Also, it is possible to reduce the non-uniformity of the image density, thereby maintaining the image quality, irrespective of the difference of the luminescence intensity of the charge eliminating device.

According to the image forming apparatus, the image forming method and the program of the present disclosure, it is possible to reduce the non-uniformity of the image density even when the luminescence intensity of the charge eliminating lamp is changed.

DETAILED DESCRIPTION

Figure 1:
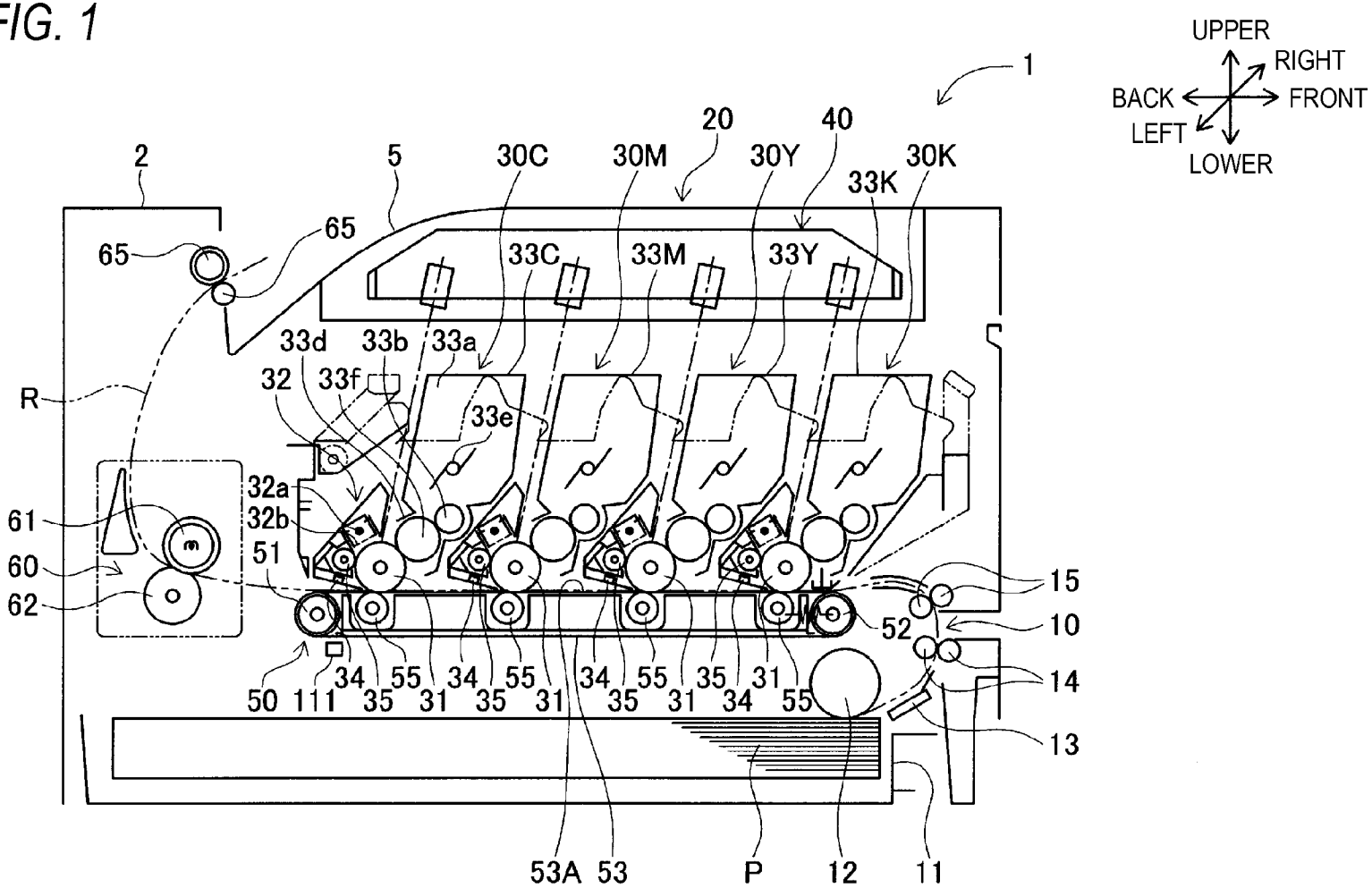
FIG. 1 is a sectional view illustrating a schematic configuration of a laser printer according to a first illustrative embodiment.

FIG. 1 is a view schematically illustrating a sectional structure of a laser printer 1 according to a first illustrative embodiment of the present disclosure. The laser printer 1 is a so-called tandem type laser printer using toners of four colors. Here, the toner is an example of the developer.

The descriptions given below, correspond to directions described on the basis of a user who uses the laser printer 1. That is, in FIG. 1, the right side is referred to as 'front', the left side is referred to as 'back', the front side is referred to as 'left' and the inner side is referred to as 'right'. Also, the upper-lower direction in FIG. 1 is referred to as 'upper-lower direction'.

As shown in FIG. 1, the laser printer 1 has a substantially box-shaped main body housing 2. The laser printer 1 is configured to accommodate a feeder device 10, an image forming device 20 and the like in the main body housing 2. An upper surface of the main body housing 2 is provided with a discharge tray 5, and a sheet P having an image formed thereon is stacked on the discharge tray 5.

The feeder device 10 is a part of the laser printer 1 configured to feed the sheet P, which is a medium to be recorded, to the image forming unit 20. The feeder device 10 has a sheet feeding tray 11, a feeder roller 12, a separation pad 13, conveyance rollers 14, and register rollers 15. The sheet feeding tray 11 is detachably mounted to a lower part of the main body housing 2. The sheet feeding tray 11 is configured to accommodate therein the sheet P. The feeder device 10 is configured to feed the sheets P in the sheet feeding tray 11 one at a time towards the image forming unit 20.

The image forming unit 20 is arranged at a substantial central portion in the main body housing 2. The image forming unit 20 has process cartridges 30C, 30M, 30Y, 30K, an exposure device 40, a transfer device 50, and a fixing device 60.

The toners of cyan (C), magenta (M), yellow (Y) and black (K) are respectively accommodated in the process cartridges 30C, 30M, 30Y, 30K.

Here, configurations of the process cartridge 30C to the process cartridge 30K will be described. In the meantime, the process cartridge 30C to the process cartridge 30K have the same configuration, except for the colors of the toners, which are the developers. Therefore, the process cartridge 30C to the process cartridge 30K are collectively referred to as 'the process cartridge 30' and the configuration thereof is described.

The process cartridge 30 has a photosensitive drum 31, a charger 32, a toner cartridge 33, and the like. The charger 32 is a scorotron-type charger having a charging wire 32*a* and a grid part 32*b*. The charger 32 is configured to positively charge a surface of the photosensitive drum 31 in a uniform manner before forming an electrostatic latent image, upon formation of an image. Specifically, a positive voltage is applied to the charging wire 32*a*, so that a potential difference is formed between the charging wire and the photosensitive drum 31 and a corona discharge is generated. At this time, the grid part 32*b* is applied with a grid bias Vg, so that a charging potential of the surface of the photosensitive drum 31 is controlled.

The toner cartridge 33 has a toner accommodation chamber 33*a*, a supply roller 33*b*, a developing roller 33*f*, a layer thickness regulation blade 33*d*, and an agitator 33*e*. The toner accommodation chamber 33*a* is configured to accommodate therein the toner of a toner color corresponding to the process cartridge 30. The agitator 33*e* is configured to stir the toner accommodated in the toner accommodation chamber 33*a*. The toner is charged to a positive potential by the stirring.

The supply roller 33*b* is configured to supply the toner in the toner accommodation chamber 33*a* to the developing roller 33*f*. The developing roller 33*f* is arranged downstream of the charger 32 in a rotating direction of the photosensitive drum 31. The developing roller 33*f* has a roller shaft and a rubber roller covering a circumference of the roller shaft and made of a conductive rubber material, which are not shown. The roller shaft is applied with a developing bias Vb by a developing bias applying circuit Cb, which will be described later.

The developing roller 33*f* is supplied with the charged toner adjusted to have a predetermined thickness by the supply roller 33*b* and the layer thickness regulation blade 33*d*. A potential difference is formed between the developing roller 33*f* and a potential of the electrostatic latent image formed on the photosensitive drum 31 by the developing bias Vb applied to the developing roller 33*f*. Meanwhile, in the below descriptions, the potential of the electrostatic latent image is referred to as the electrostatic latent image potential VL. The potential difference is adjusted by the developing bias Vb, so that the toner supplied to the developing roller 33*f* is moved to the photosensitive drum 31. The toner moved to the photosensitive drum 31 is carried on the surface of the photosensitive drum 31.

In the meantime, the toner cartridge 33 is a collective term including four types of a toner cartridge 33C, a toner cartridge 33M, a toner cartridge 33Y and a toner cartridge 33K. For example, the toner cartridge 33 configuring the process cartridge 30K is the toner cartridge 33K configured to accommodate the black toner (K) in the toner accommodation chamber 33*a*. Likewise, the process cartridge 30C to the process cartridge 30Y are associated with the toner cartridge 33C to the toner cartridge 33Y, respectively.

A charge eliminating lamp 34 and a cleaning roller 35 are arranged in corresponding order at an upstream side of the charger 32 in the rotating direction of the photosensitive drum 31. The charge eliminating lamp 34 is an illuminator having a light emission source such as an LED, and is configured to eliminate charges on the surface of the photosensitive drum 31 by illuminating light onto the surface of the photosensitive drum 31 having completed the transfer. The cleaning roller 35 is configured by a sponge roller and is arranged to contact the photosensitive drum 31 with a predetermined pressure. As the photosensitive drum 31 is rotated, the cleaning roller 35 cleans the surface of the photosensitive drum 31.

The exposure device 40 is arranged at the uppermost part in the main body housing 2, and has a laser light source, a polygon mirror, an fθ lens, a reflector and the like, which are not shown. A laser beam emitted from the laser light source is deflected at the polygon mirror, passes through the fθ lens, is adjusted as regards a light path thereof by the reflector and is then illuminated to the surface of the photosensitive drum 31 through between the charger 32 and the developing roller 33*f*. A potential of a part of the surface of the photosensitive drum 31, to which the laser beam is illuminated, is lowered. In the below descriptions, the corresponding potential is referred to as the electrostatic latent image potential VL. Thereby, an electrostatic latent image is formed.

The transfer device 50 is arranged between the developing roller 33*f* and the charge eliminating lamp 34 in the rotating direction of the photosensitive drum 31. The transfer device 50 is configured to form a color image on the sheet P while conveying the sheet P fed by the feeder device 10 towards the discharge tray 5. The transfer device 50 is arranged above the feeder device 10 and below the process cartridge 30. As shown in FIG. 1, the transfer device 50 has a driving roller 51, a driven roller 52, a conveyance belt 53, a plurality of transfer rollers 55, and the like.

The conveyance belt 53 is an endless belt formed by configuring a belt into an annular shape, and is bridged between the driving roller 51 positioned at a rear end-lower side of the process cartridge 30 and the driven roller 52 positioned at a front end-lower side of the process cartridge 30. In the meantime, as described later, the conveyance belt 53 is formed with a patch for measuring a density of an image by the toner, for each toner.

The respective transfer rollers 55 are configured to contact the conveyance belt 53 from a backside of a sheet conveying surface 53A of the conveyance belt 53 at positions facing the respective photosensitive drums 31 with the sheet conveying surface 53A being interposed therebetween. The respective transfer rollers 55 are applied with a transfer voltage at predetermined timing, thereby transferring a toner image carried on the surface of the photosensitive drum 31 to the sheet P being conveyed along the sheet conveying surface 53A.

On a conveyance path R of the sheet P, the fixing device 60 is arranged downstream of the transfer device 50 with respect to the conveying direction. As shown in FIG. 1, the fixing device 60 has a heating roller 61 and a pressing roller 62, and is configured to fix the toner image transferred on the sheet P.

Two optical sensors 111 are provided at a rear-lower side of the conveyance belt 53 and are aligned in a line in the left-right direction. Each optical sensor 111 is a reflection-type sensor having a light emitting element such as an LED and a light receiving element such as a photo transistor. Specifically, the light emitting element is configured to emit the light to the surface of the conveyance belt 53 in an oblique direction, and the light receiving element is configured to receive the reflected light from the surface of the conveyance belt 53. Thereby, a density of the patch formed on the conveyance belt 53 is measured.

Operations that are performed upon the image formation in the laser printer 1 are described. First, the laser printer 1 controls the driving of the feeder device 10 to convey the sheet P towards the image forming unit 20. At this time, in the image forming unit 20, the charges on the surface of the photosensitive drum 31 are eliminated by the light illuminated from the charge eliminating lamp 34, and the electrostatic latent image transferred to the sheet P is thus erased. Then, the toner remaining on the surface of the photosensitive drum 31 is removed by the cleaning roller 35. Then, the surface of each photosensitive drum 31 is uniformly positively charged by each charger 32, and is illuminated and exposed by the laser beam emitted from the exposure device 40 on the basis of print data. Thereby, the surface of each photosensitive drum 31 is formed thereon with an electrostatic latent image corresponding to each toner color.

When the supply roller 33*b* and the developing roller 33*f* are rotated, the toner in the toner accommodation chamber 33*a* is carried on the developing roller 33*f*. The toner is supplied to the electrostatic latent image formed on the surface of the photosensitive drum 31 when the developing roller 33*f* faces and contacts the photosensitive drum 31. Thereby, the electrostatic latent image on the surface of the photosensitive drum 31 becomes visible, and the toner image is carried on the surface of the photosensitive drum 31.

After that, the toner image carried on the surface of the photosensitive drum 31 is transferred to the sheet P by a transfer voltage applied to the transfer roller 55. Then, the sheet P having the toner image transferred thereon is conveyed to the fixing device 60 in which it is heat-fixed and an image is thus formed. The sheet P is discharged to the discharge tray 5 by discharge rollers 65. The sheet P is discharged to the discharge tray 5, so that the laser printer 1 completes the image forming operation. In the meantime, the photosensitive drum 31 having completed the transfer to the sheet P are charge-eliminated by the charge eliminating lamp 34 and is cleaned by the cleaning roller 35, so that it is ready for next printing processing.

Figure 2:
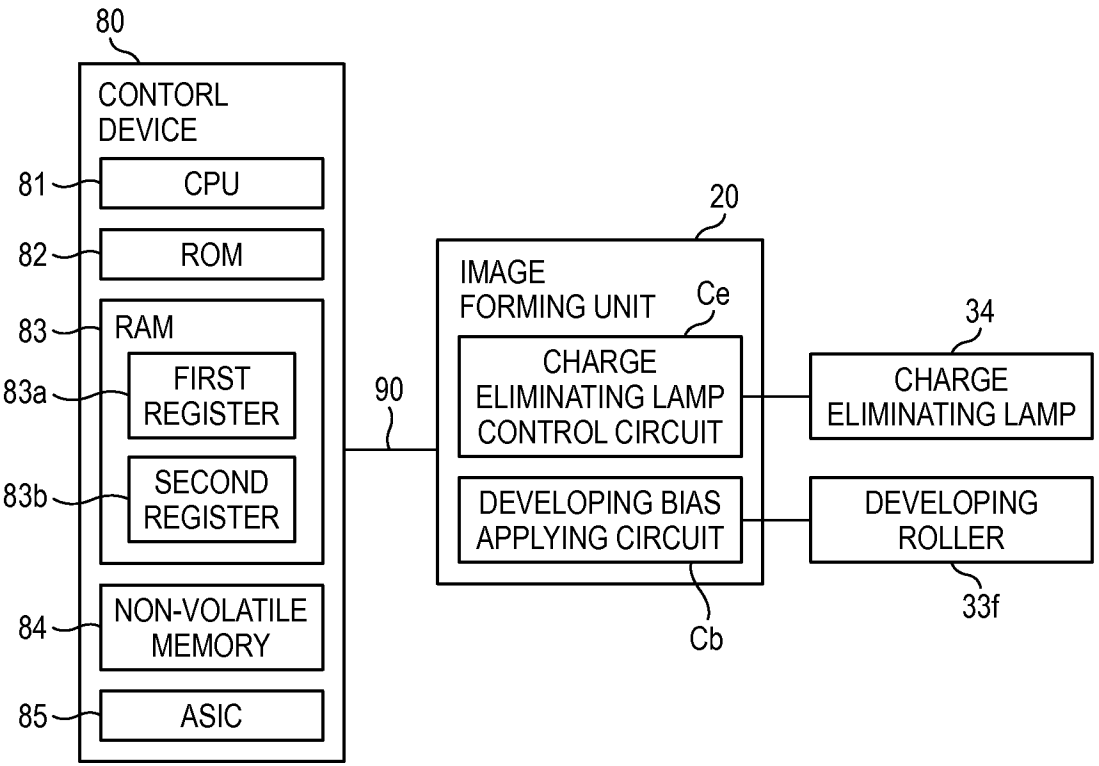
FIG. 2 is a block diagram showing an electrical configuration of the laser printer according to the first illustrative embodiment.

FIG. 2 shows an electrical configuration of the laser printer 1 according to the first illustrative embodiment. A control device 80 has a CPU 81, a ROM 82, a RAM 83, a non-volatile memory 84, and an ASIC 85. The CPU 81 is configured to execute a variety of programs stored in the ROM 82, thereby controlling the respective units of the laser printer 1 connected through a bus 90. Here, the respective units are the image forming unit 20, and the like. In the ROM 82, a control program, various data, and the like are stored. The RAM 83 is used as a main storage device for executing a variety of processing by the CPU 81. Also, the RAM 83 is provided with a first register 83*a* and a second register 83*b*. The first register 83*a* is configured to store time at which the luminescence intensity of the charge eliminating lamp 34 is switched, and a developing bias Vb of the printing that is performed as the switching is made. The second register 83*b* is configured to store an accumulated number of printed sheets. The non-volatile memory 84 is a flash memory, an HDD, an EEPROM, and the like, for example.

The image forming unit 20 includes a charge eliminating lamp control circuit Ce and a developing bias applying circuit Cb. The charge eliminating lamp control circuit Ce and the developing bias applying circuit Cb are respectively connected to the charge eliminating lamp 34 and the roller shaft of the developing roller 33*f*. The charge eliminating lamp control circuit Ce is configured to output a control signal for controlling a light emission duty to the charge eliminating lamp 34, based on a control signal from the control device 80. The light emission duty is controlled, so that the luminescence intensity of the charge eliminating lamp 34 is controlled. Also, the developing bias applying circuit Cb is configured to control the developing bias Vb to be applied to the roller shaft of the developing roller 33*f*, based on a control signal from the control device 80. In the meantime, the charge eliminating lamp 34 and the developing bias Vb are controlled for each toner color.

In the below, the surface potential of the photosensitive drum 31 upon the image formation is described. When image forming processing starts, the charge eliminating lamp 34 emits the light, and the charges on the surface of the photosensitive drum 31 are eliminated. Then, the surface of the photosensitive drum 31 is positively charged by the charger 32. At this time, the surface potential of the photosensitive drum 31 becomes 800V, for example. Meanwhile, in the below descriptions, the surface potential of the positively charged photosensitive drum 31 is referred to as the charging potential VO. Then, when the laser beam of the exposure device 40 is illuminated to the surface of the photosensitive drum 31, the surface potential of the illuminated part is lowered to the electrostatic latent image potential VL. For example, the surface potential is lowered to 100 to 150V. Then, the positively charged toner is supplied to the photosensitive drum 31 by the developing roller 33*f*. At this time, the roller shaft of the developing roller 33*f* is applied with the developing bias Vb of 300 to 450V, for example. For this reason, the positively charged toner is attached to the electrostatic latent image formed on the surface of the photosensitive drum 31 by the potential difference caused by the electrostatic latent image potential VL and the developing bias Vb, so that the electrostatic latent image is developed.

The paper dust, the toner and the like may be attached to the photosensitive drum 31. As a result, a defect that black spots and the like are printed with a rotating period of the photosensitive drum 31 may occur. Here, in the below descriptions, the defect that black spots and the like are printed with a rotating period of the photosensitive drum 31 is referred to as an image quality defect of a drum period. Further, since the paper dust, the toner and the like are likely to be attached to the photosensitive drum 31 under high humidity environments, the image quality defect of a drum period is predominant under high humidity environments. According to the investigation of the inventors, it has been proven that the image quality defect of a drum period under high humidity environments is improved by turning off the charge eliminating lamp 34 or lowering the luminescence intensity. Therefore, in some cases, to improve the image quality defect of a drum period under high humidity environments the charge eliminating lamp 34 is turned off or the luminescence intensity is lowered.

On the other hand, however, it has been proven that when the luminescence intensity of the charge eliminating lamp 34 is switched, a difference occurs in a density of an image to be printed. Specifically, it is observed in some cases that when the charging potential VO is provided upon the lighting or lights-out of the charge eliminating lamp 34, a density of the printed image is darker when the charge eliminating lamp 34 is turned off, as compared to when the charge eliminating lamp 34 is turned on. Therefore, in the first illustrative embodiment, a technology of the image forming apparatus capable of suppressing a difference in the density of the image before and after the switching even when the luminescence intensity of the charge eliminating lamp 34 is switched is disclosed. According to the first illustrative embodiment, it is possible to maintain a density of an image to be printed and to secure a desired image quality, irrespective of the switching of the luminescence intensity of the charge eliminating lamp 34.

Figure 3:
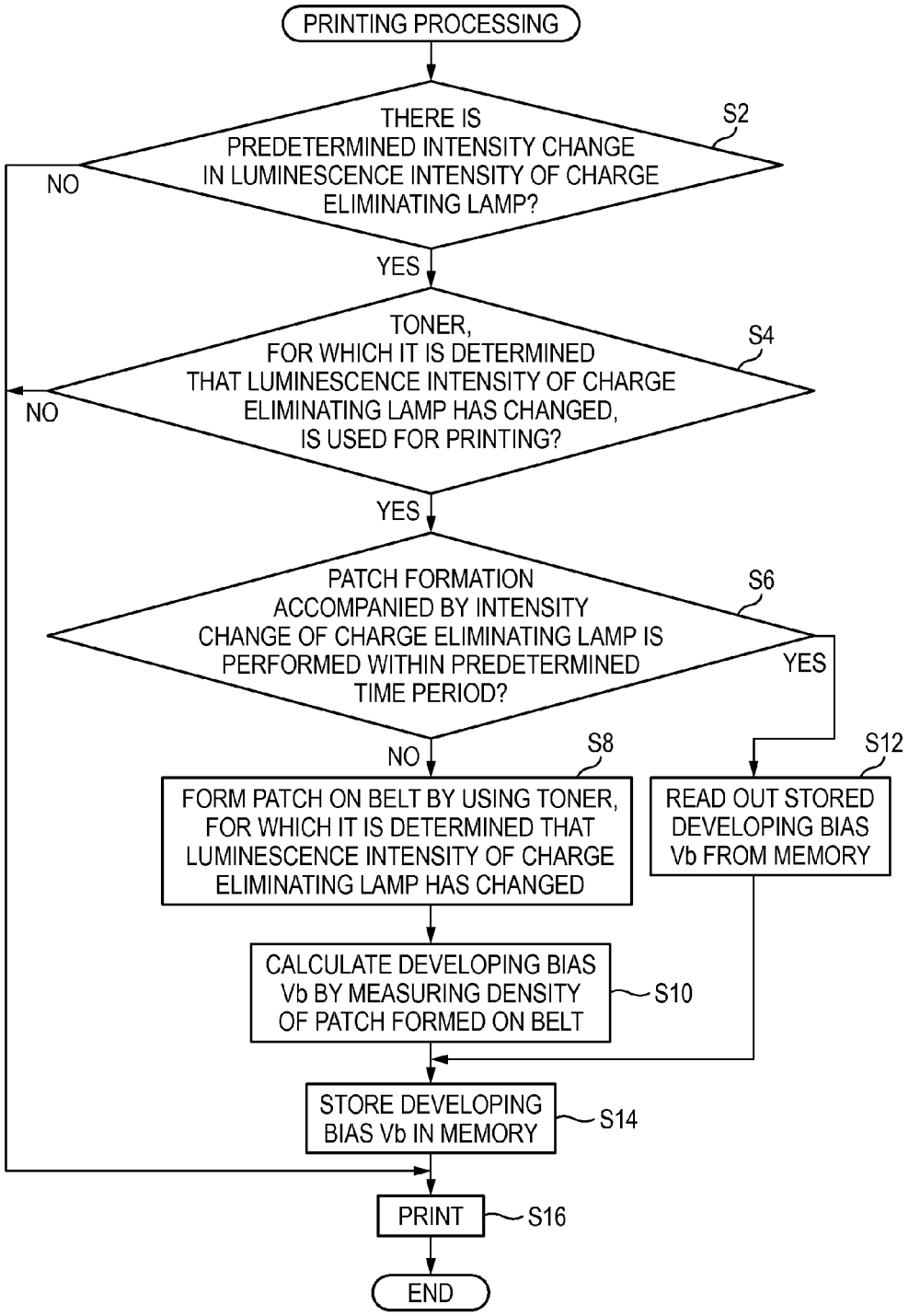
FIG. 3 is a flowchart showing printing processing of the first illustrative embodiment.

FIG. 3 is a flowchart of printing processing according to the first illustrative embodiment.

The control device 80 determines the light emission duty of the charge eliminating lamp 34 and switches the luminescence intensity, based on a signal from a humidity sensor (not shown) provided for the laser printer 1. According to the investigation, it has been proven that the image quality defect of a drum period is predominant at the humidity of 40% or higher, for example. Therefore, the control device 80 performs a control of switching the lighting and lights-out of the charge eliminating lamp 34 so that the charge eliminating lamp 34 is turned off at the humidity of 40% or higher by setting the light emission duty of the charge eliminating lamp 34 to 0% and the charge eliminating lamp 34 is turned on at the humidity less than 40% by setting the light emission duty of the charge eliminating lamp 34 to 100%. Also, the control device 80 stores the luminescence intensity of the charge eliminating lamp 34 in the first register 83*a* of the RAM 83, Here, although not shown in FIG. 3, the switching of the luminescence intensity may be performed in the printing processing shown in the flowchart of FIG. 3 when a printing command is received. Alternatively, although not shown in FIG. 3, the switching processing of the luminescence intensity may be performed at a step before a printing command is received. In the meantime, the humidity sensor is arranged for each photosensitive drum 31 of the process cartridge 30 corresponding to the toner of each color, so that it is possible to control the charge eliminating lamp 34 for each process cartridge 30 corresponding to the toners of other colors. Here, in FIG. 4, as described later, a density characteristic with respect to the developing bias Vb is different for each toner color and over time. Specifically, the developing bias Vb necessary to increase a predetermined transmission density increases in order of black (K)<cyan (C)<magenta (M)<yellow (Y). For this reason, the setting flow of the developing bias Vb in steps S6 to S14, which will be described later, is performed for each toner in accordance with the control of the lighting and lights-out of the charge eliminating lamp 34 for each toner.

When a printing command is received, the control device 80 determines whether a predetermined intensity change occurs in the luminescence intensity of the charge eliminating lamp 34 (S2). For example, when the light emission duty of the charge eliminating lamp 34 is 100%, i.e., the charge eliminating lamp 34 is turned on in the previous printing but the light emission duty of the charge eliminating lamp 34 is 0%, i.e., the charge eliminating lamp 34 is turned off in this printing or when the charge eliminating lamp 34 is switched from the lights-out to the lighting, the control device 80 determines that a predetermined intensity change occurs in the luminescence intensity (S2: YES), and proceeds to next step S4. Here, it is assumed that the predetermined intensity change becoming a determination standard is preset depending on an influence of an image density change resulting from a change in the luminescence intensity of the charge eliminating lamp 34 on a printing quality. Also, when it is determined that the change in the luminescence intensity of the charge eliminating lamp 34 is less than the predetermined intensity (S2: NO), the control device 80 executes the printing in accordance with a preset printing condition (S16).

When it is determined that a predetermined intensity change occurs in the luminescence intensity of the charge eliminating lamp 34 (S2: YES), the control device 80 determines whether the toner of the color, for which it is determined that a predetermined intensity change occurs in the luminescence intensity of the charge eliminating lamp 34, is used for the printing (S4). For example, if the predetermined intensity change occurs in the luminescence intensity of the charge eliminating lamp 34 of the process cartridge 30C corresponding to cyan (C), when a printing command of a color printing using cyan (C) is received, it is determined that the toner of cyan (C) is used (S4: YES), and the control device 80 proceeds to step S6. On the other hand, when a printing command of a monochrome printing not using cyan (C) is received, for example, it is determined that the toner of cyan (C) is not used (S4: NO), and the control device 80 executes the printing in accordance with the preset printing conditions (S16).

When it is determined that the toner, for which it is determined that the luminescence intensity is changed, is used for the printing (S4: YES), the control device 80 determines whether the patch formation is made in a predetermined time period so as to measure a density of an image accompanied by the change in the luminescence intensity of the charge eliminating lamp 34 (S6). The control device 80 reads out the previous time, at which the luminescence intensity has been switched to the same luminescence intensity as the luminescence intensity switched upon this printing, from the first register 83*a* of the RAM 83, and determines whether the elapsed time from the read previous time to the current time is within a predetermined time period. In the meantime, a time period from the read previous time to time at which the printing processing starts may be set as the elapsed time.

When it is determined that the elapsed time is within the predetermined time period (S6: YES), the control device 80 reads out the developing bias Vb, which is stored in the first register 83*a* in step S14 (which will be described later)) (S12). Here, the read developing bias Vb is the developing bias Vb upon the previous printing performed when the luminescence intensity was switched in the same manner.

For example, when the humidity is used as an index of the switching between the lighting and lights-out of the charge eliminating lamp 34, if the humidity is close to a switching threshold, a switching frequency between the lighting and lights-out of the charge eliminating lamp 34 may increase. According to the processing of step S6, when the switching frequency is high, if the elapsed time is within the predetermined time period, it is not necessary to perform the series of processing such as the patch formation, the measurement of the patch density, the calculation of the developing bias Vb based on the measurement, and the like whenever the switching is made, and it has only to perform the simple processing of reading and setting the previous developing bias Vb from the first register 83*a*. That is, it is possible to effectively adjust the density.

Here, the predetermined time period is 24 hours (i.e., one day), for example. It may be considered that it is possible to neglect the characteristic changes in the apparatus and the toner during the elapsed time of one day. That is, when the same developing bias Vb as the bias determined in the past is set with respect to the predetermined luminescence intensity, the same image density can be obtained. In the meantime, the predetermined time period is not limited to 24 hours and can be varied due to the change in the characteristics of the apparatus and toner caused by the different environmental conditions at which the apparatus is provided. It is preferable to set the predetermined time period depending on the characteristics that are varied depending on the respective environmental conditions. For example, the predetermined time period may be set to a time zone such as a time zone in the morning, a day time zone in the afternoon, a night time zone in the evening and the like, in addition to 24 hours.

On the other hand, when it is determined that the elapsed time exceeds the predetermined time period (S6: NO), the control device 80 enables the image forming unit 20 to form a patch on the conveyance belt 53 by using the toner of the process cartridge 30 in which the luminescence intensity of the charge eliminating lamp 34 has changed (S8). After that, the control device 80 enables the optical sensor 111 to measure a density of the patch formed on the conveyance belt 53 and calculates the developing bias Vb, at which an image of which an image density is the same as before the luminescence intensity changes is obtained, by using a table of FIG. 5 (which will be described later) (S10). Here, the patch is a measuring mark that is formed on the conveyance belt 53 before the sheet P is printed. The developing bias Vb that is used when forming the patch may be within a range of values included in the density characteristic shown in FIG. 4 (which will be described later). For example, the developing bias Vb may be set to a value before switching the luminescence intensity.

It is possible to measure a change in the density at the time that the luminescence intensity of the charge eliminating lamp 34 changes by measuring a density of the formed patch. Based on the measured density and the developing bias Vb upon the patch formation, the control device 80 calculates the developing bias Vb, at which a density equivalent to the density before the luminescence intensity is switched is obtained, from parameters of FIG. 5 (which will be described later) relating to the density characteristic of FIG. 4 (which will be described later) (S10). In this case, the developing bias Vb upon the patch formation is set to a voltage value before the luminescence intensity changes. By acquiring the density of the formed patch with the developing bias Vb, it is possible to compare the densities before and after the luminescence intensity changes by the same developing bias Vb and to correct the density by using the table (which will be described later). In the meantime, the specific calculation method will be described later.

The developing bias Vb is calculated in step S10 or the developing bias Vb is read from the first register 83*a* in step S12, so that the developing bias Vb upon the printing is determined. The determined developing bias Vb is stored in the first register 83*a* (S14). After that, the control device 80 applies the developing bias Vb stored in the first register 83*a* to the developing roller 33*f*, and executes the printing (S16). Thereby, it is possible to execute the printing in which the image density is kept constant even when the charge eliminating lamp 34 is switched between the lighting and the lights-out.

In the meantime, regarding the density characteristic (refer to FIG. 4) of the image density with respect to the developing bias Vb, which is used when calculating the developing bias Vb in step S10, a gradient of a characteristic line thereof is different between the lighting and lights-out of the charge eliminating lamp 34 and the gradient is also changed by a change in the toner characteristic over time.

Figures 4, 5:
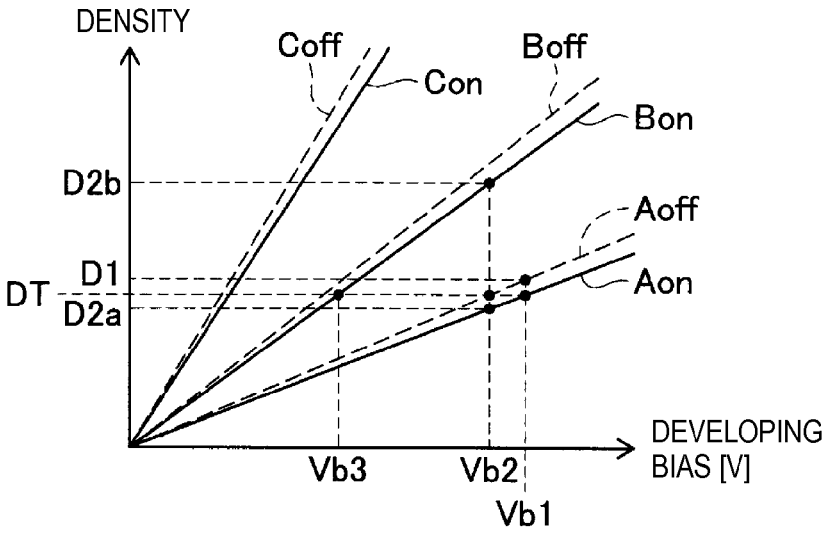
FIG. 4 illustrates a density characteristic showing a correlation between a developing bias and an image density.
FIG. 5 is a table showing a relation between the number of printed sheets and a gradient of the density characteristic.

FIG. 4 is a characteristic view of the density characteristic showing a correlation between the developing bias Vb and the density of an image to be printed. Regarding the density characteristic, the gradient of the characteristic line thereof is different between the lighting and lights-out of the charge eliminating lamp 34. When comparing the characteristic at a state where the charge eliminating lamp 34 is turned on and the characteristic at a state where the charge eliminating lamp 34 is turned off, the gradient is larger upon the lights-out, as compared to upon the lighting. Here, in FIG. 4, the line having a label 'on' indicates the lighting state, and the line having a label 'off' indicates the lights-out state. FIG. 4 shows the characteristic exemplified by a line Aoff relative to a line Aon, a line Boff relative to a line Bon, and a line Coff relative to a line Con.

Also, the gradient of the density characteristic is changed by the change in the toner characteristic over time. This will be described in a second illustrative embodiment. The charging characteristic may be different for each toner color. For this reason, the density characteristic of FIG. 4 may be different for each toner color.

FIG. 5 shows a table in which the gradients of the density characteristic for each of the lighting state of the charge eliminating lamp 34 indicated by the label 'on' and the lights-out state thereof indicated by the label 'off' are set for each of the number of printed sheets. The table is stored beforehand in the non-volatile memory 84. Here, the number of printed sheets is an index indicating the elapsed time. This will be described in the second illustrative embodiment.

Here, the method of calculating the developing bias Vb in step S10 is described in detail. A reference numeral 'DT' in FIG. 4 indicates a target density. In order to acquire the same image quality, irrespective of whether the charge eliminating lamp 34 is turned on or off, a target density corresponding to a predetermined gradation is set. The developing bias Vb is adjusted so that the density becomes the target density DT. It is assumed that the charge eliminating lamp 34 was turned on during the previous printing and the density characteristic at that time was the line Aon. It is assumed that the developing bias Vb for obtaining the target density DT is a voltage value Vb1. When the charge eliminating lamp 34 is switched to the lights-out, the density characteristic becomes the line Aoff. It is assumed that the developing bias Vb upon the patch formation in step S8 is set to the voltage value Vb1, which is the bias upon the lighting before the charge eliminating lamp 34 is switched.

The density of the patch formed at the above conditions is a density D1 darker than the target density D. Since the density characteristic is the line Aoff, in this case, L0 is read from the table of FIG. 5 stored in the non-volatile memory 84, as regards the gradient of the line Aoff. Here, it is assumed that the number of printed sheet is zero (0), i.e., just after the toner is replaced. A voltage value Vb2 of the developing bias Vb for obtaining the target density DT can be calculated from a following equation, based on the gradient L0, the voltage value Vb1 of the developing bias Vb, and the target density DT.

That is, $Vb2=Vb1+(DT-D1)/L0$

Thereby, the voltage value Vb2 of the developing bias Vb is calculated.

Here, the laser printer 1 is an example of the image forming apparatus. The photosensitive drum 31 is an example of the photosensitive member. The charge eliminating lamp 34 is an example of the charge eliminating device. The charger 32 is an example of the charging device. The developing roller 33*f* is an example of the developing device. The toner is an example of the developer. Also, the luminescence intensity upon the lighting of the charge eliminating lamp 34 is an example of the first luminescence intensity, and the luminescence intensity upon the lights-out of the charge eliminating lamp 34 is an example of the second luminescence intensity. Also, the processing of switching the lighting and lights-out of the charge eliminating lamp 34 depending on the humidity is an example of the switching processing. Also, in the flowchart of FIG. 4, step S8, step S10, and step S12 are examples of the adjustment processing. Also, step S8 is an example of the mark forming processing. Step S10 is an example of the measuring processing and the first change processing. Step S6 is an example of the calculation processing and the elapsed time determining processing. Step S12 is an example of the second change processing.

According to the first illustrative embodiment, following effects can be accomplished.

In the laser printer 1, the control device 80 switches the charge eliminating lamp 34 between the lighting and the lights-out upon the printing or prior to the printing, depending on the humidity acquired from the humidity sensor (not shown). When the charge eliminating lamp 34 relating to the toner color used for the printing is switched from the lighting to the lights-out (S2: YES, S4: YES), the control device 80 forms the patch with the developing bias Vb, which was used for the printing at the lighting state before the switching of the charge eliminating lamp 34 (S8), or when the charge eliminating lamp 34 is switched from the lights-out to the lighting (S2: YES, S4: YES), the control device 80 forms the patch with the developing bias Vb, which was set for the printing at the lights-out state before the switching of the charge eliminating lamp 34 (S8). The control device 80 measures the density of the formed patch, and changes the developing bias Vb to adjust the image density to the target density DT (S10). Alternatively, the control device 80 reads and changes the developing bias Vb, which was used for the printing at the previous lighting or lights-out state and stored in the first register 83*a*, and adjusts the image density to the target density DT (S12).

Thereby, when the charge eliminating lamp 34 is switched from the lighting to the lights-out or from the lights-out to the lighting, it is possible to adjust the density of the image, which is obtained by developing the electrostatic latent image of the photosensitive drum 31, in accordance with the switching. Also, it is possible to suppress the difference of the image density, which is caused due to the lighting and lights-out of the charge eliminating lamp 34. Also, it is possible to reduce the non-uniformity of the image density, thereby maintaining the image quality, irrespective of whether the charge eliminating lamp 34 is turned on or off.

Also, when adjusting the image density upon the printing, the control device 80 forms the patch on the conveyance belt 53 (S8 in FIG. 4) by using the developing bias Vb, which was set upon the printing performed at the lighting state, if the charge eliminating lamp 34 was switched from the lighting to the lights-out, or by using the developing bias Vb, which was set upon the printing performed at the lights-out state, if the charge eliminating lamp 34 was switched from the lights-out to the lighting, and measures the density of the formed patch (S10 in FIG. 4). Based on the measured density, the control device 80 changes the developing bias Vb to adjust the density (S10 in FIG. 4).

The voltage value of the developing bias Vb, which is used when forming the patch for measuring the image density, is the voltage value upon the printing before the switching of the charge eliminating lamp 34 between the lighting and the lights-out. That is, when the charge eliminating lamp 34 is switched from the lighting from the lights-out, the developing bias Vb upon the printing at the lighting state is set, and when the charge eliminating lamp 34 is switched from the lights-out to the lighting, the developing bias Vb upon the printing at the lights-out state is set. While switching the charge eliminating lamp 34 between the lighting and the lights-out, the patch is formed as the developing bias Vb is kept constant, as it is (S8 in FIG. 4), and the density of the formed patch is measured (S10 in FIG. 4). Thereby, it is possible to acquire the difference of the density, which is caused due to the switching of the charge eliminating lamp 34 between the lighting and the lights-out, with the same developing bias Vb. The developing bias Vb is calculated on the basis of the measured density (S10 in FIG. 4), and the developing bias Vb is changed to the calculated voltage value, so that the target density DT can be set. Thereby, it is possible to reduce the difference of the image density, irrespective of whether the charge eliminating lamp 34 is turned on or off.

Also, when adjusting the image density upon the printing, if the charge eliminating lamp 34 is switched from the lighting to the lights-out, the control device 80 calculates the elapsed time after the switching from the previous lighting to the lights-out or if the charge eliminating lamp 34 is switched from the lights-out to the lighting, the control device 80 calculates the elapsed time after the switching from the previous lights-out to the lighting. The control device 80 determines whether the calculated elapsed time is within the predetermined time period (S6 in FIG. 3). When it is determined that the calculated elapsed time does not exceed the predetermined time period (SY: YES in FIG. 3), the control device 80 reads the previous developing bias Vb from the first register 83*a* (S12 in FIG. 3) and executes the printing with the read developing bias Vb (S16 in FIG. 3).

When the switching from the lighting to the lights-out or from the lights-out to the lighting of the charge eliminating lamp 34 does not exceed the predetermined elapsed time from the previous same switching time, it is thought that there is no great change from the state upon the printing performed in accordance with the previous same switching. Therefore, when the printing is performed with the developing bias Vb upon the printing performed in accordance with the previous same switching, it is possible to adjust the image density to the same density as the previous density. Thereby, it is possible to adjust the image density without executing the processing of the patch formation and the density measurement of the formed patch. Also, in the case where the charge eliminating lamp 34 is switched between the lighting and the lights-out depending on the humidity, even when the humidity is close to the threshold and the charge eliminating lamp 34 is frequently switched between the lighting and the lights-out, it is possible to effectively execute the printing processing without repeating the processing of the patch formation and the density measurement of the formed patch whenever the switching is made. Thus, it is possible to reduce the redundant load in the printing processing, thereby suppressing the deterioration of the apparatus, the toner and the like.

An amount of the toner to be attached to the photosensitive drum 31 is controlled in accordance with a potential difference between the electrostatic latent image potential VL, which is a potential of the photosensitive drum 31 having the electrostatic latent image formed thereon, and a voltage value of the developing bias Vb, which is a potential of the developing roller 33*f*. Thereby, it is possible to control the amount of the toner to be attached to the electrostatic latent image formed on the photosensitive drum 31 by changing the voltage value of the developing bias Vb. The larger the amount of the toner to be attached to the electrostatic latent image, the density becomes darker. Therefore, it is possible to adjust the density by changing the voltage value of the developing bias Vb.

Also, the control device 80 is configured to beforehand store the table of FIG. 5, which relates to the gradient of the density characteristic showing the correlation between the developing bias Vb and the image density, in the non-volatile memory 84. When the gradient of the density characteristic is selected from the table in accordance with the conditions such as the difference between the lighting and the lights-out of the charge eliminating lamp 34, the number of printed sheets and the like, in addition to the density of the patch formed in step S8 of the flowchart shown in FIG. 3 and the developing bias Vb upon the patch formation, it is possible to calculate the developing bias Vb, at which a desired density DT is obtained, thereby changing the developing bias Vb.

The table of FIG. 5 is stored, so that it is possible to effectively determine the developing bias Vb, at which the target density DT is obtained, by measuring the image density with respect to at least one developing bias Vb.

The switching from the lighting to the lights-out of the charge eliminating lamp 34 or from the lights-out to the lighting is a condition that the change in the luminescence intensity is greatest in the charge eliminating lamp 34 and a case where the difference of the image density is greatest. Therefore, when the charge eliminating lamp 34 is switched from the lighting to the lights-out or from the lights-out to the lighting, it is possible to reduce the non-uniformity of the density by executing the processing of adjusting the image density.

Also, in the laser printer 1 capable of performing the color printing, the control device 80 can adjust the image density for each of the process cartridges 30 corresponding to the toners of respective colors. Thereby, in the laser printer 1 having the toners of multiple colors capable of forming a color image, it is possible to control the difference between the lighting and the lights-out of the charge eliminating lamp 34 for each toner color, so that it is possible to adjust the density with the different developing biases Vb, respectively. Also, it is possible to select the toner to be used for the printing and to adjust the density, so that it is possible to effectively perform the adjustment processing.

In the below, a second illustrative embodiment is described. In the second illustrative embodiment, a case where as the toner characteristic changes over time, the gradient of the density characteristic of FIG. 4 changes is described. In step S10 of the flowchart of FIG. 3, the calculation method of the developing bias Vb is different from the first illustrative embodiment.

The toner has a characteristic that a charging amount thereof gradually deteriorates over time depending on the environmental conditions, by the repetition of the toner stirring by the agitator 33*e* and the charging accompanied by the stirring or by both the factors. As the charging amount of the toner is lowered, if the electrostatic latent image potential VL of the photosensitive drum 31 and the developing bias Vb of the developing roller 33*f* are the same, the amount of the toner that is moved towards the photosensitive drum 31 by the potential difference thereof increases. The reason is that since the charging amount of the toner is lowered, the more toner is required to move so as to take an electrical balance. As the toner amount increases, the image density tends to be darker. For example, in FIG. 4, when the developing bias Vb is a voltage value Vb2 at the lighting state of the charge eliminating lamp 34, the density on the line Aon is a density D2*a* but the density on the line Bon is a density D2*b*, so that the image density becomes darker.

As shown in FIG. 4, over time the gradient of the density characteristic becomes greater as the charging amount of the toner decreases. The lines Aon, Aoff, the lines Bon, Boff and the lines Con, Coff indicate the characteristic when time elapses in corresponding order.

In the table of FIG. 5, the gradient is stored in correspondence to the number of printed sheets. The change of the toner characteristic over time can be inferred by using the accumulated number of printed sheets of the laser printer 1 as an index. The reason is that it is thought that the accumulated number of printed sheets has a positive correlation with a time period for which the toner is kept under the environmental conditions. In FIG. 4, for example, the lines Aon, Aoff correspond to the accumulated number of printed sheets '0', the lines Bon, Boff correspond to the accumulated number of printed sheets '500', and the lines Con, Coff correspond to the accumulated number of printed sheets '1,000'.

In the flowchart of FIG. 3, when executing the processing of step S10, the accumulated number of printed sheets is read from the second register 83*b*. The gradient in the table can be selected depending on the read number of printed sheets. For example, the gradient of the number of printed sheets '0' is applied to a case where the accumulated number of printed sheets is equal to or larger than '0' and smaller than 500, the gradient of the number of printed sheets '500' is applied to a case where the accumulated number of printed sheets is equal to or larger than '500' and smaller than 1,000, and the gradient of the number of printed sheets '1,000' is applied to a case where the accumulated number of printed sheets is equal to or larger than '1,000'. Also, a table in which an accumulated rotation number of the agitator 33*e* is used as an index of the time elapsed, instead of the accumulated number of printed sheets, may be configured. It is possible to determine the charging amount of the toner by the accumulated number of printed sheets or the accumulated rotation number of the agitator 33*e*. It is assumed that the charge eliminating lamp 34 was turned off during the previous printing and the density characteristic at that time was the line Aoff. It is assumed that the developing bias Vb for obtaining the target density DT was a voltage value Vb2. Then, printing was executed such that the accumulated number of printed sheets was equal to or larger than 500 and smaller than 1,000, and such an accumulated number of printed sheets was registered in the second register 83*b*. Thereafter, when the charge eliminating lamp is switched to the lights-on, the density of the patch formed in step S8 by applying the voltage value Vb2, which is the bias set as the developing bias Vb in the previous printing, is a density D2*b*. In step S10, the control device 80 measures the density D2*b* as the density of the formed patch. Also, the control device 80 reads the accumulated number of printed sheets, which is equal to or larger than 500 and smaller than 1,000, from the second register 83*b*, and selects a gradient K1 corresponding to such an accumulated number of printed sheets. A voltage value Vb3 of the developing bias Vb for obtaining the target density DT can be calculated from a following equation, based on the voltage value Vb2 of the developing bias Vb, the measured density D2*b* of the formed patch, the selected gradient K1, and the target density DT:

$$Vb3=Vb2+(DT-D2b)/K1.$$

Here, in the second illustrative embodiment, regarding the description of the processing of step S10 in the flowchart of FIG. 3, the processing of selecting the gradient in the table, depending on the accumulated number of printed sheets or the accumulated rotation number of the agitator 33*e*, by using the number of printed sheets in the table of FIG. 5 as a predetermined value is an example of the charging amount determining processing.

According to the second illustrative embodiment, following effects can be accomplished.

The control device 80 can estimate the charging amount of the toner in accordance with the accumulated number of printed sheets, and select the gradient of the density characteristic from the table of FIG. 5, depending on the charging amount of the toner. Specifically, the numbers of printed sheets in the table are set as predetermined values, the number of printed sheets in the table is determined depending on the accumulated number of printed sheets, and the gradient corresponding to the determined number of printed sheets is selected. Then, it is possible to calculate the developing bias Vb by using the gradient of the density characteristic, depending on the charging amount of the toner.

In the meantime, the present disclosure is not limited to the above illustrative embodiments, and can be variously improved and changed without departing from the gist of the present disclosure. For example, regarding the calculation processing of the developing bias Vb in step S10 of the flowchart of FIG. 3 relating to the printing processing of the first and second illustrative embodiments, processing different from the processing of the first illustrative embodiment may be executed. For example, instead of the configuration of storing the gradients in the table, patches may be formed for each of the two different developing biases Vb and densities of the respective patches may be measured to calculate a gradient of a specific line.

Also, the density may be adjusted by using a table in which a correction amount of the developing bias Vb is associated with a change amount of the luminescence intensity of the charge eliminating lamp 34. In this case, the correction amount of the developing bias Vb with respect to a predetermined change in the luminescence intensity of the charge eliminating lamp 34 may be obtained in advance by a test, a measurement and the like. Thereby, in the flowchart of FIG. 3, the correction amount can be determined by referring to the table, instead of the processing of steps S8 and S10.

Also, in the first illustrative embodiment, the image density is adjusted by the developing bias Vb. However, the present disclosure is not limited thereto. Instead of changing the developing bias Vb, the luminescence intensity of the laser beam of the exposure device 40 configured to form the electrostatic latent image on the photosensitive drum 31 may be changed. Here, the laser beam is an example of the illumination light.

As the intensity of the laser beam increases, the potential of the electrostatic latent image to be formed on the surface of the photosensitive drum 31 is lowered, the potential difference from the developing bias Vb to be applied to the developing roller 33*f* increases and the potential difference between the photosensitive drum 31 and the developing roller 33*f* increases. As a result, the amount of the toner to be attached to the electrostatic latent image formed on the photosensitive drum 31 increases, so that the image density becomes darker. Thus, it is possible to adjust the image density by changing the intensity of the laser beam to adjust the potential difference between the electrostatic latent image to be formed on the photosensitive drum 31 and the developing roller 33*f*.

For example, as the luminescence intensity of the laser beam decreases, the electrostatic latent image potential VL increases, so that the potential difference from the developing bias Vb decreases. Thereby, the amount of the toner to be attached to the electrostatic latent image formed on the photosensitive drum 31 is decreased, so that the image density becomes lighter. To the contrary, when the luminescence intensity of the laser beam is increased, the electrostatic latent image potential VL decreases, so that the potential difference from the developing bias Vb increases. Thereby, the amount of the toner to be attached to the electrostatic latent image is increased, so that the image density becomes darker. In this way, it is possible to adjust the image density by changing the luminescence intensity of the laser beam.

Also, instead of the configuration of adjusting the image density by the developing bias Vb in the first illustrative embodiment, the grid bias Vg to be applied to the grid part 32*b* of the charger 32 may be changed. Here, the grid bias Vg is an example of the voltage value of the charging bias.

The surface potential of the photosensitive drum 31 is charged to the positive potential by the grid bias Vg applied to the grid part 32*b* of the charger 32. The charging potential is lowered to the electrostatic latent image potential VL as the electrostatic latent image is formed by the laser beam of the exposure device 40. When the charging potential is increased by increasing the grid bias Vg, the electrostatic latent image potential VL is correspondingly increased. When the electrostatic latent image potential VL is increased, the potential difference from the developing bias Vb is decreased and the amount of the toner to be attached to the electrostatic latent image formed on the photosensitive drum 31 is reduced, so that the image density becomes lighter. To the contrary, when the charging potential is decreased by decreasing the grid bias Vg, the electrostatic latent image potential VL is correspondingly decreased, so that the potential difference from the developing bias Vb is increased. As a result, the amount of the toner to be attached to the electrostatic latent image formed on the photosensitive drum 31 is increased, so that the image density becomes darker. In this way, it is possible to adjust the image density by changing the grid bias Vg.

Also, in step S10 of the flowchart of the printing processing of the second illustrative embodiment, the accumulated number of printed sheets or the accumulated rotation number of the agitator 33*e* has been exemplified as the index over time of the change of the toner characteristic. However, the present disclosure is not limited thereto. For example, elapsed time from replacement of the process cartridge 30 or accumulated energization time of the developing bias Vb to the developing roller 33*f* may also be used as the index.

Also, in the first illustrative embodiment, the charge eliminating lamp 34 of the process cartridge 30 corresponding to each toner color is independently controlled. However, the present disclosure is not limited thereto. For example, the charge eliminating lamps corresponding to cyan (C), magenta (M) and yellow (Y) may be commonly controlled, and the charge eliminating lamps corresponding to all colors including black (K) may be commonly controlled. In this way, it is possible to simplify the control of the charge eliminating lamps 34 by the common control.

Also, in the first illustrative embodiment, the laser printer 1 has been exemplified. However, the present disclosure is not limited thereto. For example, the present disclosure can also be applied to a complex machine having a scanner function, a copy function, a facsimile function and the like.

Also, in the first illustrative embodiment, the control device 80 has the CPU 81. However, the present disclosure is not limited thereto. For example, the control device 80 may have a plurality of CPUs or may be configured by the ASIC 85. Further, the control device 80 may be configured by a combination of the CPU 81 and the ASIC 85.

The present disclosure is not limited to the following, but can be implemented in a variety of aspects, such as an image forming method, a program for enabling the image forming apparatus to implement a predetermined function, a method of determining the developing bias, a recording medium having recorded therein a program for enabling the image forming apparatus to implement a predetermined function, and the like.

Further, according to the image forming apparatus of the present disclosure, the control device is configured to: form a measuring mark by using an image forming condition in an image forming command at the first luminescence intensity, in response to the luminescence intensity being switched from the first luminescence intensity to the second luminescence intensity by the switching the luminescence intensity when an image forming command is issued, or by using an image forming condition in an image forming command at the second luminescence intensity, in response to the luminescence intensity being switched from the second luminescence intensity to the first luminescence intensity by the switching the luminescence intensity when an image forming command is issued; measure a density of the formed measuring mark; and change the image forming condition depending on the measured density.

In the image forming apparatus, when forming the measuring mark for measuring the image density, the image forming condition is an image forming command of the first luminescence intensity if the luminescence intensity is switched from the first luminescence intensity to the second luminescence intensity, and is an image forming command of the second luminescence intensity if the luminescence intensity is switched from the second luminescence intensity to the first luminescence intensity. That is, while switching the luminescence intensity of the charge eliminating device, the measuring mark is formed as the image forming condition is kept as the image forming condition before the switching of the luminescence intensity. Then, the density of the measuring mark is measured. Thereby, it is possible to acquire the difference of the density, which is caused due to the switching of the luminescence intensity, by measuring the density of the measuring mark at the same image forming condition. The image forming condition is changed depending on the measured density, so that a target density can be set. Thereby, it is possible to reduce the difference of the image density, which is caused due to the switching of the luminescence intensity of the charge eliminating device.

Still further, in the image forming apparatus of the present disclosure, in the adjusting the density, the control device is configured to: calculate elapsed time from switching to previous second luminescence intensity, in response to the luminescence intensity being switched from the first luminescence intensity to the second luminescence intensity by the switching the luminescence intensity when an image forming command is issued, or calculating elapsed time from switching to previous first luminescence intensity, in response to the luminescence intensity is switched from the second luminescence intensity to the first luminescence intensity by the switching the luminescence intensity when an image forming command is issued; determine whether the elapsed time exceeds a predetermined time period; and when it is determined that the elapsed time does not exceed the predetermined time period, change the image forming condition to an image forming condition at the previous second luminescence intensity if the luminescence intensity was switched to the second luminescence intensity or to an image forming condition at the previous first luminescence intensity if the luminescence intensity was switched to the first luminescence intensity.

When the switching of the luminescence intensity of the charge eliminating device does not exceed the predetermined elapsed time from the previous switching, it is thought that there is no great change from the state upon the image formation performed in accordance with the previous switching. Therefore, it is possible to adjust the image density with the same image forming condition as the image forming condition applied upon the image formation performed in accordance with the previous switching. Thereby, it is possible to adjust the image density without executing the processing of forming the measuring mark and measuring the density of the measuring mark. Also, in a case where the luminescence intensity of the charge eliminating device is frequently switched because the using environments are close to a boundary condition at which the luminescence intensity of the charge eliminating device is switched, it is possible to effectively execute the image forming processing without repeating the processing of forming the measuring mark and measuring the density of the measuring mark whenever the switching is made. Thus, it is possible to reduce the redundant load in the image forming apparatus, thereby suppressing the deterioration of the apparatus, the toner and the like.

Still further, in the image forming apparatus of the present disclosure, the image forming condition is a voltage value of a developing bias that is to be applied to the developing device so as to form a potential difference for moving the charged developer to the photosensitive member. The control device is configured to change the voltage value of the developing bias in the changing the image forming condition.

Here, an amount of the developer, which is to be moved from the developing device to the photosensitive member and is to be attached to the photosensitive member, is controlled in accordance with a potential difference between a potential of the photosensitive member having the electrostatic latent image formed thereon and a voltage value of the developing bias, which is a potential of the developing device. Thereby, it is possible to control the amount of the developer to be attached to the electrostatic latent image formed on the photosensitive member by changing the voltage value of the developing bias. The larger the amount of the developer to be attached to the electrostatic latent image of the photosensitive member, the density becomes darker. Therefore, it is possible to adjust the density by changing the voltage value of the developing bias.

Still further, in the image forming apparatus of the present disclosure, the control device is configured to determine whether a charging amount of the developer is below a predetermined value. In the changing the image forming condition, the control device reduces the voltage value of the developing bias when it is determined that the charging amount of the developer is below the predetermined value.

As time advances or as the charging of the developer by the static electricity is repeated, the charging efficiency is deteriorated, so that a charging amount of the developer is lowered. For this reason, at the voltage value at which the developing bias is the same, the amount of the developer that is to be attached to the electrostatic latent image increases as the charging amount of the developer is lowered. As a result, the density may increase. Therefore, when it is determined that the charging amount of the developer is below the predetermined value, the voltage value of the developing bias is lowered. Thereby, it is possible to reduce the amount of the developer that is to be attached to the electrostatic latent image, thereby adjusting the density.

Still further, in the image forming apparatus of the present disclosure, the image forming condition is an intensity of an illumination light that is to be illuminated to the photosensitive member so as to form the electrostatic latent image. The control device is configured to change the intensity of the illumination light in the changing the image forming condition.

For example, the higher the intensity of the illumination light, a potential of the electrostatic latent image to be formed on the surface of the photosensitive member is lowered and a potential difference from the developing bias to be applied to the developing device, so that a potential difference between the photosensitive member and the developing device increases. As a result, the amount of the developer to be attached to the electrostatic latent image formed on the photosensitive member increases, so that the image density becomes darker. By changing the intensity of the illumination light, it is possible to adjust the potential difference between the electrostatic latent image to be formed on the photosensitive member and the developing device, thereby adjusting the image density.

Still further, in the image forming apparatus of the present disclosure, the control device is configured to determine whether a charging amount of the developer is below a predetermined value. In the changing the image forming condition, the control device reduces the intensity of the illumination light when it is determined that the charging amount of the developer is below the predetermined value.

In this way, when it is determined that the charging amount of the developer is below the predetermined value, the intensity of the illumination light is reduced to increase the potential of the electrostatic latent image to be formed on the surface of the photosensitive member, so that the potential difference from the developing device can be reduced. Thus, it is possible to reduce the amount of the developer to be attached to the electrostatic latent image, thereby adjusting the density.

Still further, in the image forming apparatus of the present disclosure, the image forming condition is a voltage value of a charging bias of the charging device for charging the photosensitive member. The control device is configured to change the voltage value of the charging bias in the changing the image forming condition.

A surface potential of the photosensitive member charged to the predetermined positive potential by the charging device is lowered due to the formation of the electrostatic latent image. When the voltage value of the charging bias is changed, the potential of the photosensitive member upon the charging is changed, so that the potential of the electrostatic latent image to be formed on the surface of the photosensitive member is changed. By changing the voltage value of the charging bias, it is possible to adjust the potential difference between the electrostatic latent image on the photosensitive member and the developing device, thereby adjusting the image density.

Still further, in the image forming apparatus of the present disclosure, the control device is configured to determine whether a charging amount of the developer is below a predetermined value. In the changing the image forming condition, the control device increases the voltage value of the charging bias when it is determined that the charging amount of the developer is below the predetermined value.

When it is determined that the charging amount of the developer is below the predetermined value, the voltage value of the developing bias is increased. Thereby, the potential of the charged photosensitive member is increased, so that the potential of the electrostatic latent image is also increased. The potential difference between the potential of the electrostatic latent image and the voltage value of the developing bias of the developing device is decreased, so that the potential difference between the photosensitive member and the developing device is reduced. Thus, it is possible to reduce the amount of the developer to be attached to the electrostatic latent image, thereby adjusting the density.

Still further, in the image forming apparatus of the present disclosure, the control device is configured to store in advance correlation information for specifying a correlation between the image forming condition and the density of the image, for each of the first luminescence intensity and the second luminescence intensity of the charge eliminating device or depending on whether a charging amount of the developer is below a predetermined value, or for each of the first luminescence intensity and the second luminescence intensity of the charging device and depending on whether a charging amount of the developer is below a predetermined value. In the first change processing, the control device is configured to change the image forming condition to a condition, at which a predetermined target density is obtained, based on the correlation information, the image forming condition at which the measuring mark is formed in the forming the measuring mark and the density of said measuring mark.

Thereby, it is possible to deduce an image forming condition, at which a predetermined target density is obtained, and to change the image forming condition to the corresponding image forming condition, based on the stored correlation information, the image forming condition that is used upon the formation of the measuring mark, and a measuring result of the density of the formed measuring mark. In this case, since the correlation information is stored for each of the first luminescence intensity and the second luminescence intensity of the charge eliminating device or depending on whether a charging amount of the developer is below a predetermined value or depending on both factors, it is possible to obtain a favorable image forming condition, depending on the difference in the luminescence intensity of the charge eliminating device, depending on the difference in the charging amount of the developer or depending on both factors.

Still further, in the image forming apparatus of the present disclosure, the first luminescence intensity of the charge eliminating device is an intensity that is to be detected at a lighting state of the charge eliminating device, and the second luminescence intensity is an intensity that is to be detected at a lights-out state of the charge eliminating device.

According thereto, it is possible to adjust the image density and to suppress the density difference even when the charge eliminating device is switched between the lighting and the lights-out.

Still further, in the image forming apparatus of the present disclosure, the photosensitive member, the charge eliminating device, the charging device and the developing device are provided for each of a plurality of different developers. The control device is configured to adjust the density by different image forming conditions for each of the plurality of developers.

According thereto, when the plurality of developers, for example, the developers of multiple colors capable of forming a color image, is provided, it is possible to adjust the density with the different image forming conditions for each of the multiple developers. Thus, it is possible to independently execute the switching of the luminescence intensity of the charge eliminating device for each developer, to switch the luminescence intensity for each developer and to optimize the density adjustment. Also, it is possible to select the target developer from the multiple developers to be used for the image formation and to execute the switching processing and adjustment processing for the selected developer, so that it is possible to effectively adjust the density.

What is claimed is:

1. An image forming apparatus comprising:

a photosensitive member;

a charge eliminating device configured to eliminate charge on the photosensitive member;

a charging device configured to charge the charge-eliminated photosensitive member;

a developing device configured to attach charged developer to an electrostatic latent image, which is formed on the charged photosensitive member, by an electrostatic force and to develop the electrostatic latent image; and a control device configured to:

switch a luminescence intensity of the charge eliminating device between a first luminescence intensity and a second luminescence intensity, the second luminescence intensity being lower than the first luminescence intensity; and adjust a density of an image, which is obtained by developing the electrostatic latent image by the developing device, in response to the luminescence intensity being switched from the first luminescence intensity to the second luminescence intensity or from the second luminescence intensity to the first luminescence intensity, wherein to adjust the density, the control device is further configured to:

calculate elapsed time from switching to previous second luminescence intensity, in response to the luminescence intensity being switched from the first luminescence intensity to the second luminescence intensity by switching the luminescence intensity when an image forming command is issued, or calculate elapsed time from switching to previous first luminescence intensity, in response to the luminescence intensity being switched from the second luminescence intensity to the first luminescence intensity by switching the luminescence intensity when an image forming command is issued;

determine whether the elapsed time exceeds a predetermined time period; and when it is determined that the elapsed time does not exceed the predetermined time period, change the image forming condition to an image forming condition at the previous second luminescence intensity if the luminescence intensity was switched to the second luminescence intensity or to an image forming condition at the previous first luminescence intensity if the luminescence intensity was switched to the first luminescence intensity.

2. The image forming apparatus according to claim 1, wherein in the adjusting the density, the control device is configured to:

form a measuring mark by using an image forming condition in an image forming command at the first luminescence intensity, in response to the luminescence intensity being switched from the first luminescence intensity to the second luminescence intensity by switching the luminescence intensity when an image forming command is issued, or by using an image forming condition in an image forming command at the second luminescence intensity, in response to the luminescence intensity being switched from the second luminescence intensity to the first luminescence intensity by switching the luminescence intensity when an image forming command is issued;

measure a density of the formed measuring mark; and change the image forming condition depending on the measured density.

3. The image forming apparatus according to claim 2, wherein the image forming condition is a voltage value of a developing bias that is to be applied to the developing device so as to form a potential difference for moving the charged developer to the photosensitive member, and wherein the control device is configured to change the voltage value of the developing bias in the changing the image forming condition.

4. The image forming apparatus according to claim 3, wherein the control device is configured to determine whether a charging amount of the developer is below a predetermined value, and wherein in the changing the image forming condition, the control device reduces the voltage value of the developing bias when it is determined that the charging amount of the developer is below the predetermined value.

5. The image forming apparatus according to claim 2, wherein the image forming condition is an intensity of an illumination light that is to be illuminated to the photosensitive member so as to form the electrostatic latent image, and wherein the control device is configured to change the intensity of the illumination light in the changing the image forming condition.

6. The image forming apparatus according to claim 5, wherein the control device is configured to determine whether a charging amount of the developer is below a predetermined value, and wherein in the changing the image forming condition, the control device reduces the intensity of the illumination light when it is determined that the charging amount of the developer is below the predetermined value.

7. The image forming apparatus according to claim 2, wherein the image forming condition is a voltage value of a charging bias of the charging device for charging the photosensitive member, and wherein the control device is configured to change the voltage value of the charging bias in the changing the image forming condition.

8. The image forming apparatus according to claim 7, wherein the control device is configured to determine whether a charging amount of the developer is below a predetermined value, and wherein in the changing the image forming condition, the control device increases the voltage value of the charging bias when it is determined that the charging amount of the developer is below the predetermined value.

9. The image forming apparatus according to claim 2, wherein the control device is configured to store in advance correlation information for specifying a correlation between the image forming condition and the density of the image, for each of the first luminescence intensity and the second luminescence intensity of the charge eliminating device or depending on whether a charging amount of the developer is below a predetermined value, or for each of the first luminescence intensity and the second luminescence intensity of the charge eliminating device and depending on whether the charging amount of the developer is below a predetermined value, and wherein in the change of the image forming condition depending on the measured density, the control device is configured to change the image forming condition to a condition, at which a predetermined target density is obtained, based on the correlation information, the image forming condition at which the measuring mark is formed in the forming the measuring mark and the density of said measuring mark.

10. The image forming apparatus according to claim 1, wherein the first luminescence intensity of the charge eliminating device is an intensity that is to be detected at a lighting state of the charge eliminating device, and the second luminescence intensity is an intensity that is to be detected at a lights-out state of the charge eliminating device.

11. The image forming apparatus according to claim 1, wherein the photosensitive member, the charge eliminating device, the charging device and the developing device are provided for each of a plurality of different developers, and wherein the control device is configured to adjust the density by different image forming conditions for each of the plurality of developers.

12. The image forming apparatus according to claim 1, further comprising:

a humidity sensor, wherein the control device is configured to switch the luminescence intensity of the charge eliminating device between the first luminescence intensity and the second luminescence intensity based on a detection result of the humidity sensor.

13. The image forming apparatus according to claim 12, wherein the control device is configured to:

when the detection result of the humidity sensor indicates that the humidity is less than a predetermined humidity, set the luminescence intensity of the charge eliminating device to the first luminescence intensity; and when the detection result of the humidity sensor indicates that the humidity is equal to or greater than the predetermined humidity, set the luminescence intensity of the charge eliminating device to the second luminescence intensity.

14. An image forming method of an image forming apparatus comprising a photosensitive member; a charge eliminating device configured to eliminate charge on the photosensitive member; a charging device configured to charge the charge-eliminated photosensitive member; and a developing device configured to attach charged developer to an electrostatic latent image, which is formed on the charged photosensitive member, by an electrostatic force and to develop the electrostatic latent image, the method comprising:

switching a luminescence intensity of the charge eliminating device between a first luminescence intensity and a second luminescence intensity, the second luminescence being lower than the first luminescence intensity; and adjusting a density of an image to be obtained by developing the electrostatic latent image by the developing device, in response to the luminescence intensity being switched from the first luminescence intensity to the second luminescence intensity or from the second luminescence intensity to the first luminescence intensity, wherein adjusting the density comprises:

calculating elapsed time from switching to previous second luminescence intensity, in response to the luminescence intensity being switched from the first luminescence intensity to the second luminescence intensity by switching the luminescence intensity when an image forming command is issued, or calculating elapsed time from switching to previous first luminescence intensity, in response to the luminescence intensity being switched from the second luminescence intensity to the first luminescence intensity by switching the luminescence intensity when an image forming command is issued;

determining whether the elapsed time exceeds a predetermined time period; and when it is determined that the elapsed time does not exceed the predetermined time period, changing the image forming condition to an image forming condition at the previous second luminescence intensity if the luminescence intensity was switched to the second luminescence intensity or to an image forming condition at the previous first luminescence intensity if the luminescence intensity was switched to the first luminescence intensity.

15. The image forming method according to claim 14, further comprising:

forming a measuring mark by using an image forming condition in an image forming command at the first luminescence intensity, in response to the luminescence intensity being switched from the first luminescence intensity to the second luminescence intensity by switching the luminescence intensity when an image forming command is issued, or by using an image forming condition in an image forming command at the second luminescence intensity, in response to the luminescence intensity being switched from the second luminescence intensity to the first luminescence intensity by switching the luminescence intensity when an image forming command is issued;

measuring a density of the formed measuring mark; and changing the image forming condition depending on the measured density.

* * * * *